US006276708B1

(12) United States Patent
Hogstedt

(10) Patent No.: US 6,276,708 B1
(45) **Date of Patent: *Aug. 21, 2001**

(54) SNOWBOARD BOOT AND BINDING ASSEMBLY

(76) Inventor: Roy L. Hogstedt, 1200 Esplande Ave., No. 307, Redondo Beach, CA (US) 90277

( * ) Notice: Subject to any disclaimer, the term of this patent is extended or adjusted under 35 U.S.C. 154(b) by 0 days.

This patent is subject to a terminal disclaimer.

(21) Appl. No.: 09/547,232

(22) Filed: Apr. 11, 2000

Related U.S. Application Data

(63) Continuation-in-part of application No. 09/008,996, filed on Jan. 20, 1998, now Pat. No. 6,056,312.

(51) Int. Cl.[7] ..... A63C 9/00

(52) U.S. Cl. ..... 280/613; 280/14.22; 280/624; 280/619; 36/117.1

(58) Field of Search ..... 280/14.21, 14.22, 280/624, 619, 613; 36/115, 117.1, 117.7; 24/269

(56) References Cited

U.S. PATENT DOCUMENTS 4,021,056 * 5/1977 Oakes ..... 280/613
4,177,584 * 12/1979 Beyl ..... 36/117.1
4,205,467 * 6/1980 Salomon ..... 36/119
4,546,524 * 10/1985 Kreft ..... 24/269
5,660,410 * 8/1997 Alden ..... 280/627
5,695,210 * 12/1997 Goss et al. ..... 280/624
5,697,631 * 12/1997 Ratzek et al. ..... 280/613
6,056,312 * 5/2000 Hogstedt ..... 280/624

* cited by examiner

*Primary Examiner*—J. J. Swann
*Assistant Examiner*—James S. McClellan
(74) *Attorney, Agent, or Firm*—Leonard Tachner

(57) ABSTRACT

A contact configuration between boot and binding for snowboarding. Contact pins are provided on opposing sides of the boot at both the heel area and the toe area. This 4-point contact configuration assures heel and toe stability and reliable side boot restraint. Concave mating receptacles at matching locations on the binding assure easy and simple interconnection which is also secure and reliable. A release mechanism is provided to selectively retract the pins using a simple pull cord arrangement. Strap linkages permit more convenient tightening and loosening of the boot straps. A strap/yoke configuration provides improved interconnection between the boot and the user's foot. The pull cord is routed within the sole of the boot and upward along the ankle area of the boot for more convenient access. The pull cord is connected to retract linkages at both heel and toe areas, both of those linkages being spring loaded to provide normally extended pins. A variety of pin receptacle configurations are shown for facilitating boot-to-binding step-in connection.

18 Claims, 14 Drawing Sheets

SNOWBOARD BOOT AND BINDING ASSEMBLY

CROSS-RELATED APPLICATIONS

The present application is a continuation-in-part of application Serial No. 09/008,996 filed on Jan. 20, 1998 and now issued U.S. Pat. No. 6,056,312

BACKGROUND OF THE INVENTION

1. Field of the Invention

The present invention pertains generally to the field of snowboarding equipment and more particularly to a new configuration of snowboarding boots and bindings providing convenient grasp and release at distinct points of contact on opposing sides of toes and heels, respectively.

2. Prior Art

Various snowboard binding systems have been disclosed in the prior art. By way of example, U.S. Pat. Nos. 5,190,311; 5,558,355; 4,973,073; 5,577,757; 5,564,719; 5,474,322; 5,505,478; 5,697,631; 4,177,584; 4,205,467; 4,546,524; 5,820,155; 5,695,210; 4,021,056; 5,661,876 and 5,660,410 all disclose snowboard or ski bindings and some disclose compatible boots or shoes. However, all have deficiencies in regard to the interface between the bindings and the boots. More specifically, most of the prior art discloses insufficient contact between boot and binding such as only two points or regions of contact on opposing middle positions of the boot. Such limited contact is inadequate because it permits heel and or toe lift which reduces control of the snowboard during critical maneuvers. Other prior art provides heel and toe locking, but permits separation between boot and binding along the sides of the boot thereby reducing the security of the interface which detrimentally affects the confidence of the snowboarder. Moreover, the release mechanism for both types of prior art (i.e., side connections and heel and toe connections), is typically too cumbersome and complex making it either unreliable or too difficult to engage.

Therefore, despite the significant number of relevant prior art patent disclosures, there is still a need for a snowboard boot/binding configuration which provides sufficient interface contact to allow excellent control and security, while still offering a reliable and convenient release mechanism. There is also a need to provide a snowboard boot binding configuration which is more comfortable and has a more convenient release mechanism than existing configurations.

SUMMARY OF THE INVENTION

The present invention overcomes the deficiencies of the prior art by providing a unique contact configuration between boot and binding for snowboarding. More specifically, in the present invention, contact pins are provided on opposing sides of the boot at both the heel area and the toe area. This 4-point contact configuration assures heel and toe stability and reliable side boot restraint. Moreover, in the preferred embodiment of the invention, concave mating receptacles at matching locations on the binding, assure easy and simple interconnection which is also secure and reliable. Furthermore, a release mechanism is provided to selectively retract the pins using a simple pull cord arrangement which is both convenient and effective despite being mechanically simple and therefore reliable. An option advantageous feature of the present invention, resides in strap linkages which permit more convenient tightening and loosening of the boot straps. A strap/yoke configuration provides improved interconnection between the boot and the user's foot. The pull cord is routed within the sole of the boot and upward along the ankle area of the boot for more convenient access. The pull cord is connected to retract linkages at both heel and toe areas, both of those linkages being spring loaded to provide normally extended pins. A variety of pin receptacle configurations are shown for facilitating boot-to-binding step-in connection.

OBJECTS OF THE INVENTION

It is therefore a principal object of the present invention to provide an improved snowboard boot and binding which overcomes the deficiencies of the prior art.

It is another object of the invention to provide a snowboard boot and binding wherein a 4-point interface is used to selectively secure the boot to the binding.

It is yet another object of the invention to provide a snowboard boot and binding having both quick connect and quick release capability.

It is still an additional object of the invention to provide a snowboard boot and binding which offers greater security and control and quicker connect and disconnect as compared to the prior art.

It is still an additional object of the invention to provide a snowboard boot having more convenient pin extending and retracting linkages.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
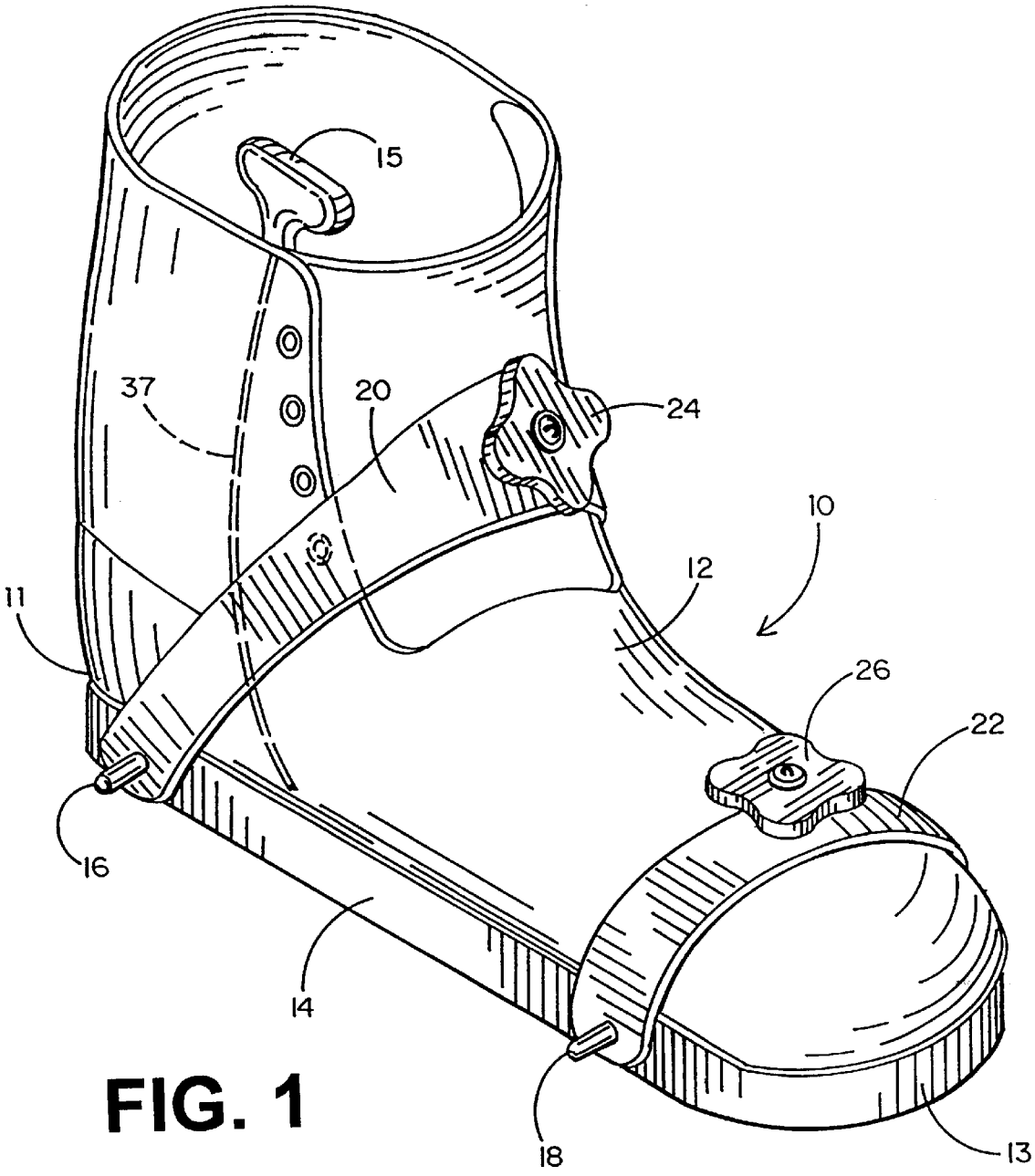
FIG. 1 is a three-dimensional view of a snowboard boot in accordance with a first embodiment of the invention.

Referring now to the accompanying figures, it will be seen that a snowboard boot 10 of the present invention comprises an upper member 12 and a lower member 14. Four pins 16, 17, 18 and 19, extend laterally from the lower member 14 in a direction which is substantially perpendicular to the length of the boot 10. The pins are located adjacent the heel and toe portions of the boot, but inward from the heel 11 and front 13 of the boot, respectively. The pins are positioned on opposite sides of the lower member 14. Boot 10 also comprises straps 20 and 22 which in the illustrated embodiment, use adjustment knobs 24 and 26, respectively to tighten and loosen the straps in a manner to be disclosed in detail below.

Figure 2:
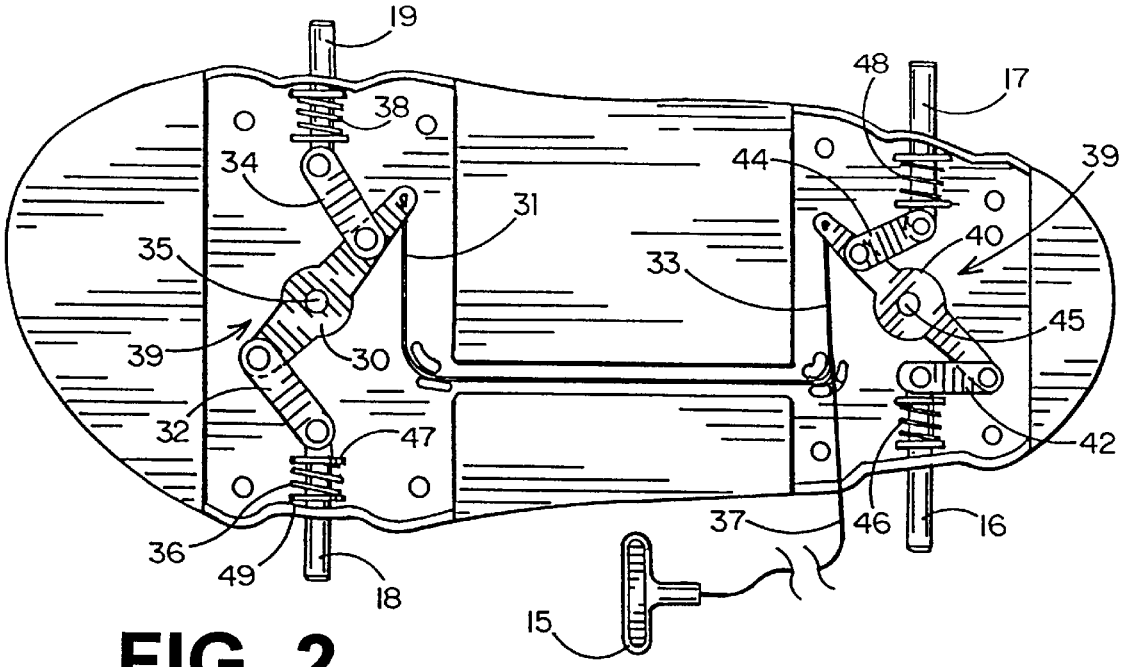
FIG. 2 is a bottom view of the boot of FIG. 1 but shown partially disassembled.
Figure 3:
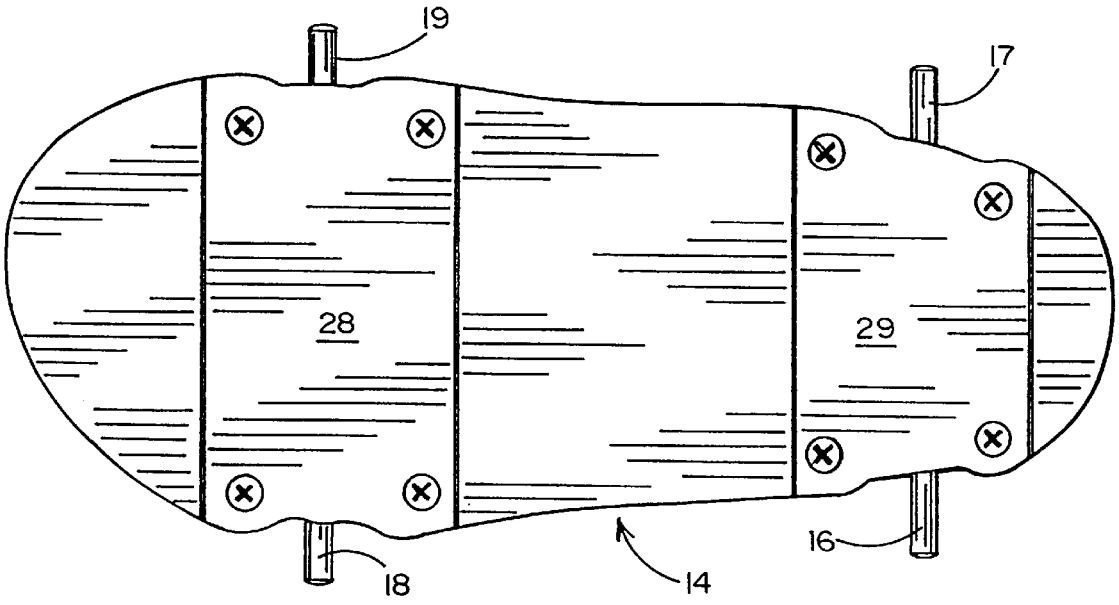
FIG. 3 is a bottom view similar to FIG. 2 but with the boot shown assembled.

It may be seen in FIGS. 2 and 3 that lower member 14 has a pair of compartments 39, access to which may be obtained by removing covers 28 and 29. Each compartment 39 houses a structure for extending and retracting pins 16, 17, 18 and 19. By way of illustration, pins 18 and 19 are each connected to a pin retractor 30 through linkages 32 and 34. Retractor 30 is secured at its center to a fulcrum 35 about which the retractor may be rotated through a limited angle. It can be seen that each pin is passed through a helical spring immediately inside the perimeter of the compartment. Thus pin 18 passes through spring 36 and pin 19 passes through spring 38. The springs are positioned between spaced apart washers such as washers 47 and 49 on pin 18. Washer 49 is affixed to the pin 18 while washer 47 is affixed to the underlying casing. Springs 36 and 38 provide a nominal extended condition of pins 18 and 19. When retractor 30 is rotated (clockwise as seen in FIG. 2), linkages 32 and 34 pull pins 18 and 19 inside compartment 39 while compressing springs 36 and 38. Retractors 30 and 40 (the latter controlling retraction of pins 16 and 17), are attached to pull-strings 31 and 33, respectively and both such pull-strings are connected to main pull-string 37 which is, in turn, attached to handle 15. Thus, when handle 15 is pulled, both retractors rotate and all four pins are retracted into the boot 10. When handle 15 is released, the springs 36, 38, 46 and 48 all expand and again extend the pins to the positions shown in FIGS. 1–3.

Figure 4:
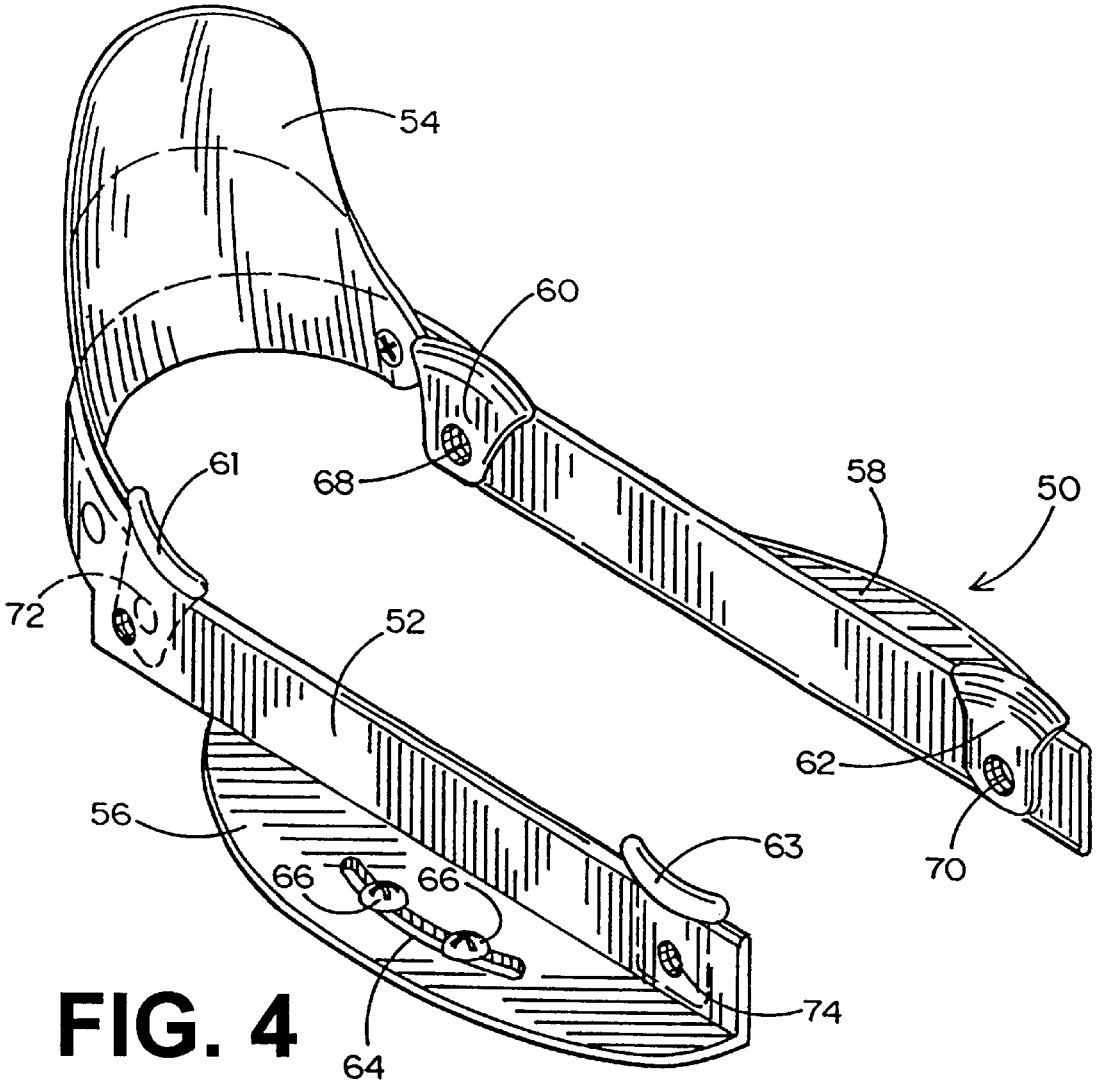
FIGS. 4 and 5 are three-dimensional and plan views, respectively, of the binding of the preferred embodiment of the invention.
Figure 5:
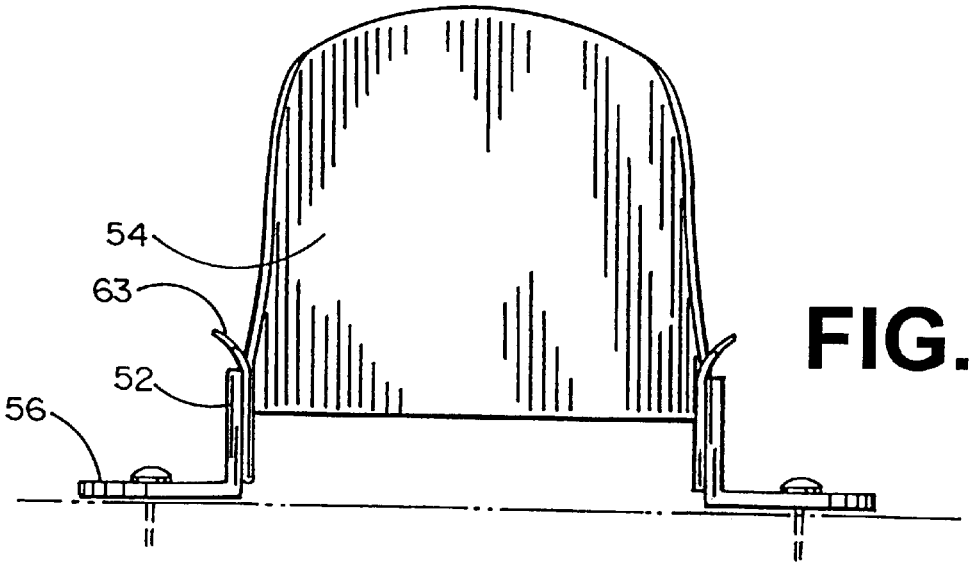
Figure 6:
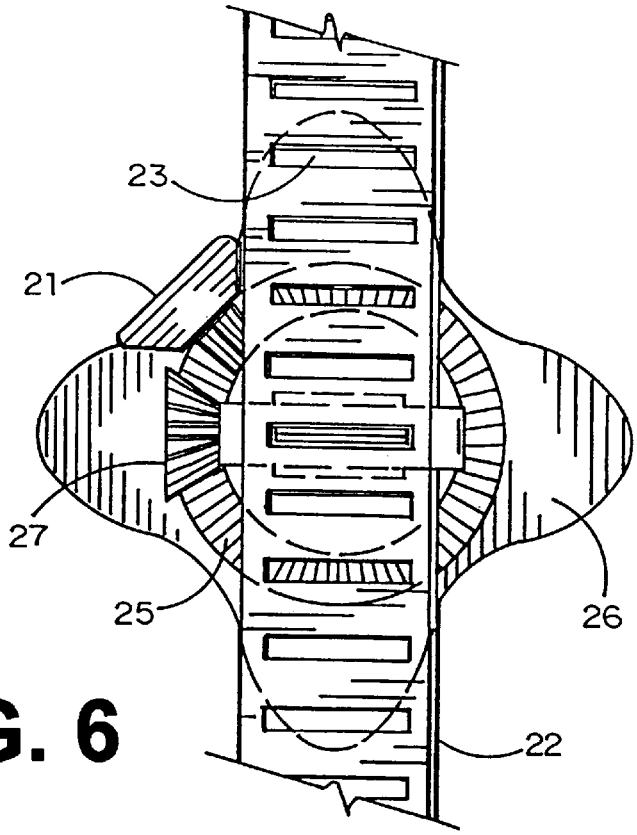
FIGS. 6 and 7 are top and bottom views respectively, of an optional strap-tightening feature of the invention.
Figure 7:
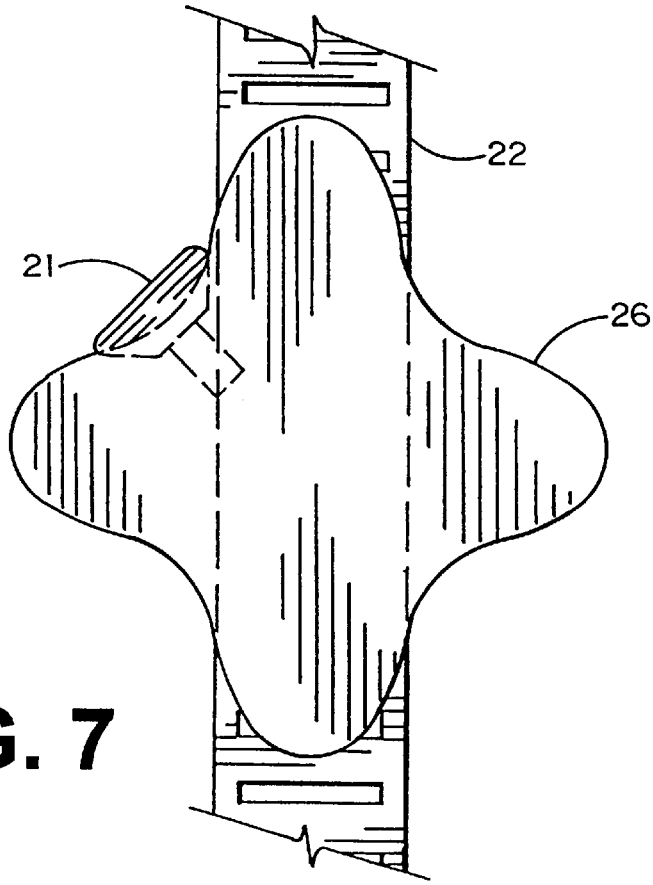
Figure 8:
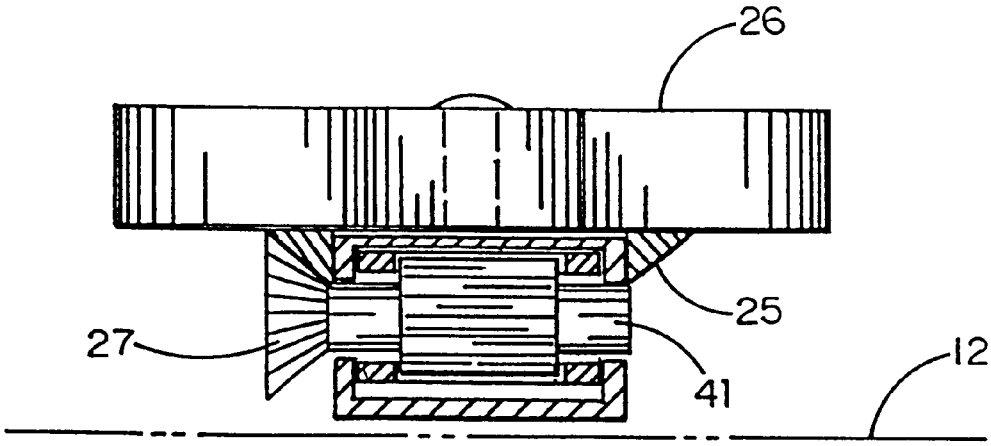
FIGS. 8 and 9 are front and side views, respectively, of the strap-tightening feature of FIGS. 6 and 7.
Figure 9:
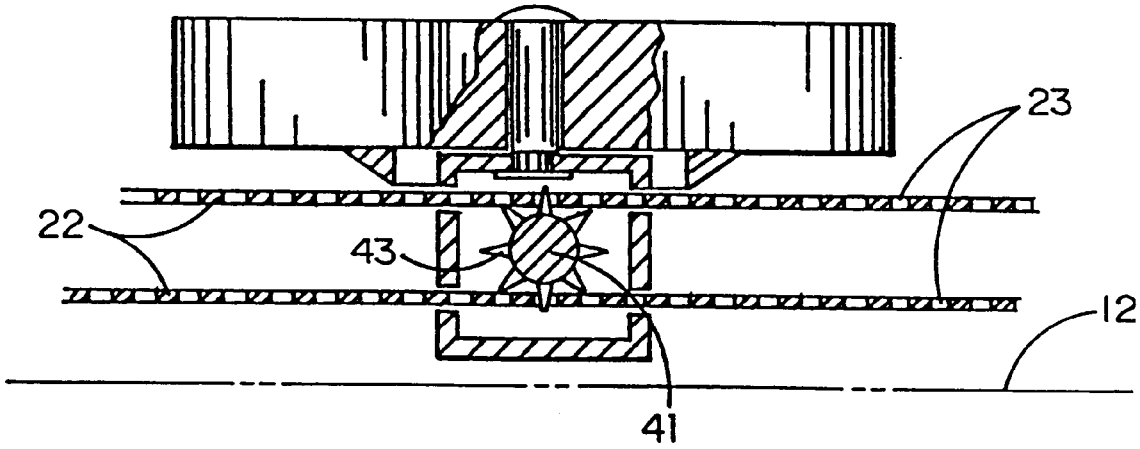
Figure 10:
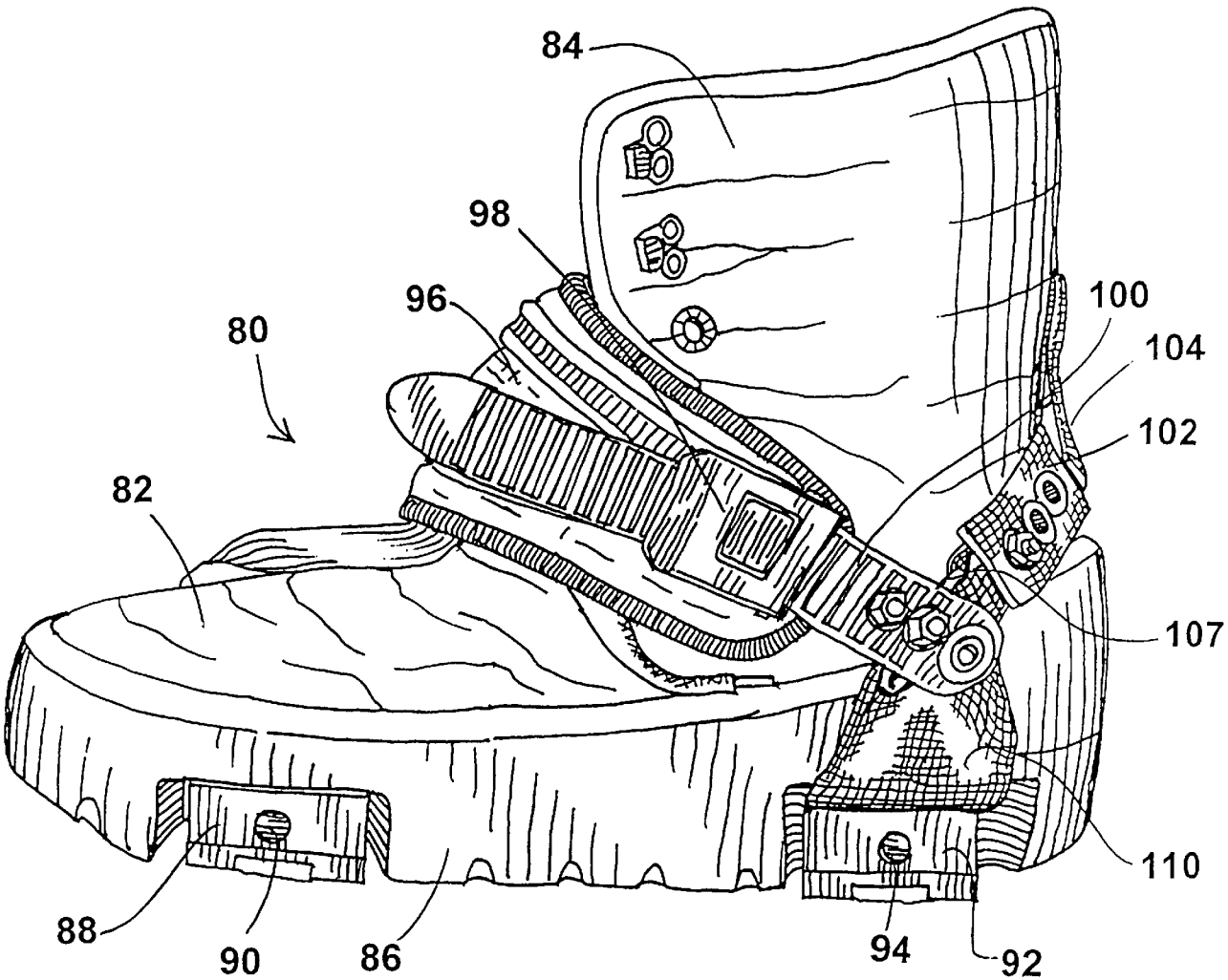
FIGS. 10 and 11 are opposing side views of an alternative embodiment of a snowboard boot in accordance with the invention.
Figure 11:
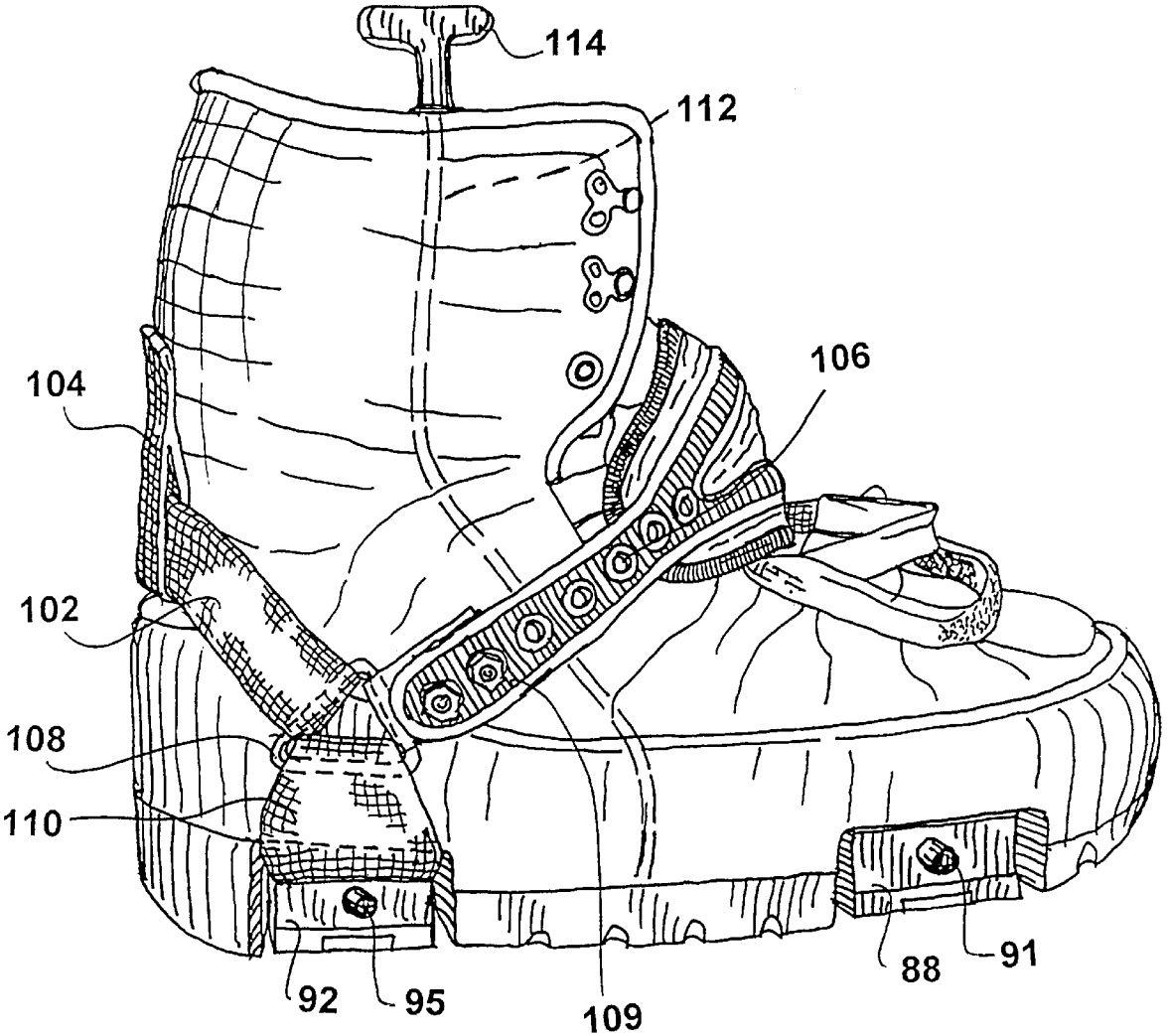
Figure 12:
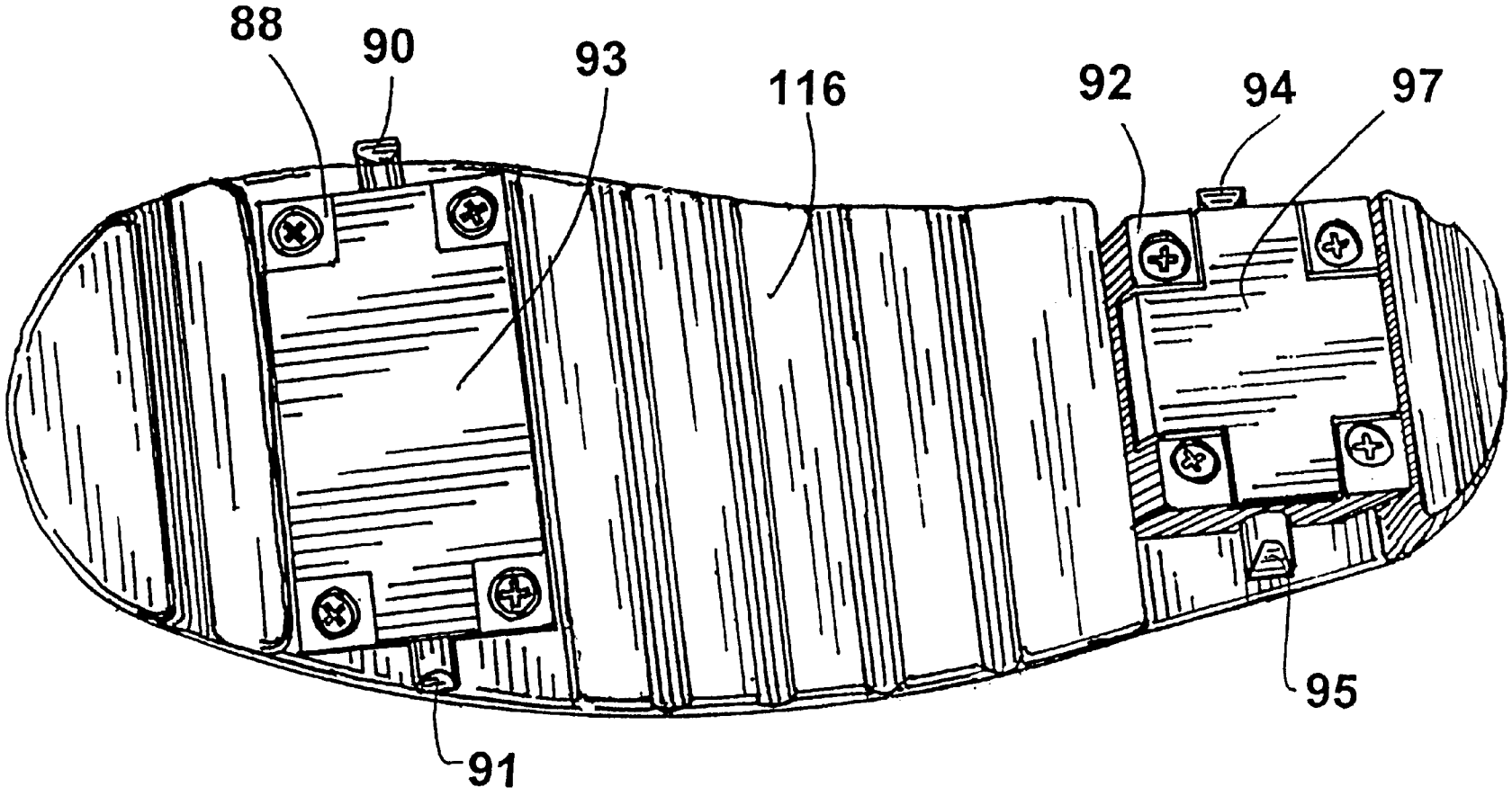
FIG. 12 is a bottom view of the alternative embodiment.

The binding 50 with which the boot 10 is designed to operate, is shown in FIGS. 4 and 5. As seen in those FIGs., snowboard binding 50 comprises a U-shaped frame 52, a rear support 54, a pair of board attachment flanges 56, 58, four pin mating receptacles 60, 61, 62, and 63 and four pin apertures 68, 70, 72 and 74 Support 54 provides both support and locating functions to facilitate placement of the boot 10 in the binding 50. Flanges 56 and 58 provide means for attaching the binding to the board while an adjustment slot 64 and set screws 66 in such flange permit adjustment of boot position on the underlying board.

Mating receptacles 60 through 63 are shaped with a concave surface facing inwardly and which tends to feed the pin into the corresponding aperture 68 through 74. These funnel-like surfaces and the spring-like pin retraction, make it far easier to feed the pins into the pin apertures without difficulty or delay.

An advantageous but optional feature of the disclosed embodiment is found in the strap tightening and loosening mechanism depicted in FIGS. 6 through 9. The belt adjustment knob 26 provides an inclined gear tread 25 which engages a gear 27, the latter being integral to a shaft 41. The shaft 41 provides a plurality of radial teeth 43. Belt 22 has discrete overlapping ends and a plurality of regularly spaced slots 23. The belt ends engage opposite sides of shaft 41 and its teeth 43. Rotation of knob 26 tightens and loosens belt 22 depending upon the direction of knob rotation. A knob-lock 21 (shown in FIGS. 6 and 7) may be provided to prevent inadvertent movement of the knob 26.

Turning now to FIGS. 10 through 21, it will be seen that the present invention may be provided in numerous alternative embodiments. By way of example, FIGS. 10-15 provide various illustrations of an alternative embodiment of the boot of the invention. More specifically, a boot 80 comprises an upper member 82 having an ankle region 84 and also comprising a lower member 86, the latter having a sole 116. A toe compartment 88 has extending therefrom pins 90 and 91. A heel compartment 92 has extending therefrom pins 94 and 95. The compartments are enclosed by respective covers 93 and 97. The boot 80 also comprises a front belt 96 having a buckle 98 mating with a strap 100. Strap 100 is secured to a triangle 107 to which a rear belt 102 is also secured. Rear belt 102 wraps around the rear portion of the boot through a loop 104 and is secured to another triangle 108. Triangle 108 also receives strap 109 extending from front belt 96. Strap 109 has a plurality of adjustment holes 106. Each triangle 107 and 108 also connects to bottom belts 110 which are secured between compartment 92 and the boot's lower member 86. The boot configuration shown best in FIGS. 10 through 15, provides even greater comfort and security to a snowboarder. 1. The various belts, straps and triangles provide a yoke configuration which, when tightened, prevents heel-lift and prevents the boot from coming off the snowboarder even under the most extreme force conditions.

Figure 13:
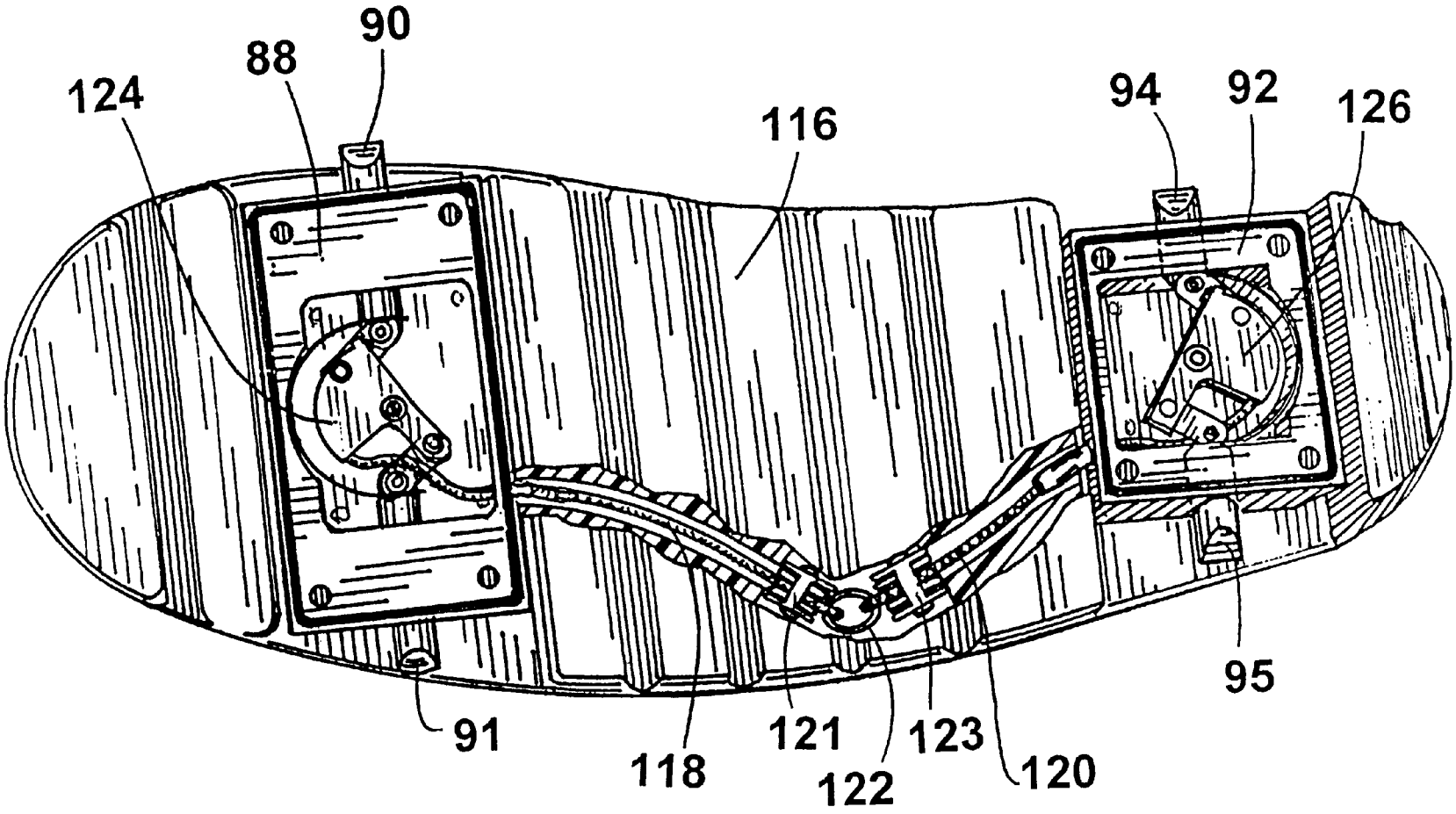
FIG. 13 is a bottom view similar to FIG. 12 but with the retraction linkages and pull cord exposed.

The bottom of boot 80, shown best in FIGS. 12 through 15, comprises a sole 116 with the two compartments 88 and 92 having respective covers 93 and 97 which are designed to be substantially flush with the sole 116. Each compartment 88 and 92 contains a respective pin retraction linkage 124 and 126. These linkages keep the four pins 90, 91, 94 and 95 in a normally extended position and provide a simple and convenient way to retract all four pins simultaneously so that the snowboarder may remove the boots from the binding and snowboard. As shown in FIG. 13, each of the linkages 124 and 126, is connected by respective retraction wires 118 and 120, through respective pulleys 121 and 123 and hole 122. The pulleys are, in turn, connected to a pull cord 112 which runs upwardly within the ankle region 84 of the boot 80 and terminates in a pull cord handle 114.

Figure 15:
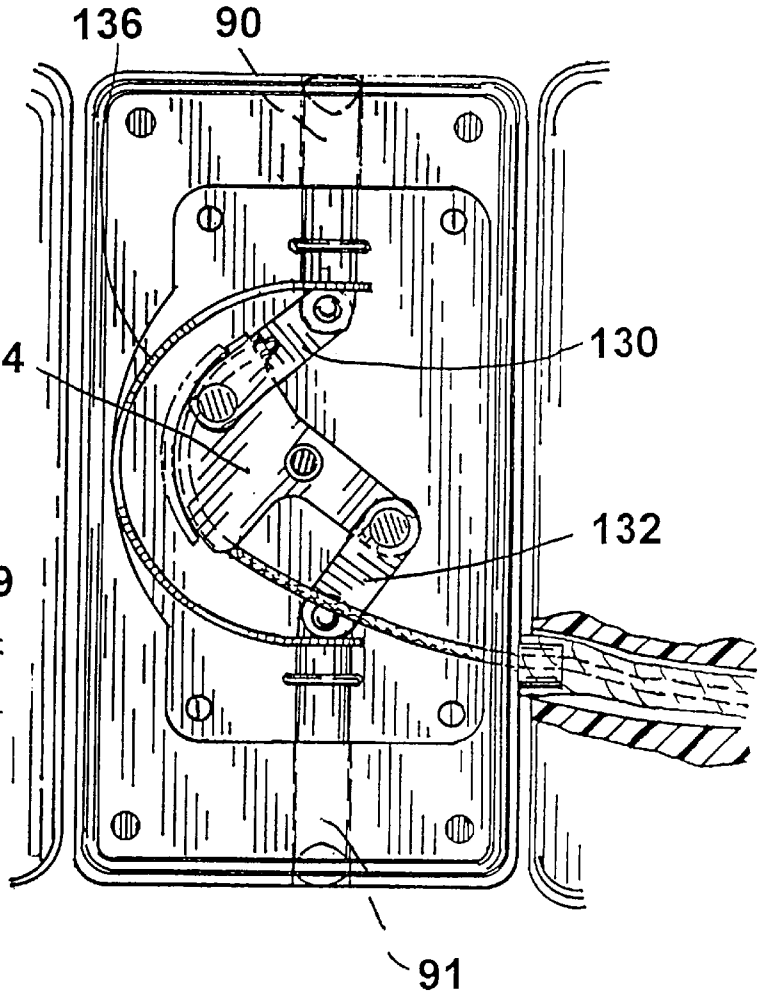
FIGS. 14 and 15 are sequential, enlarged drawings of the toe linkage showing the pins in the extended and retracted positions, respectfully.
Figure 14:
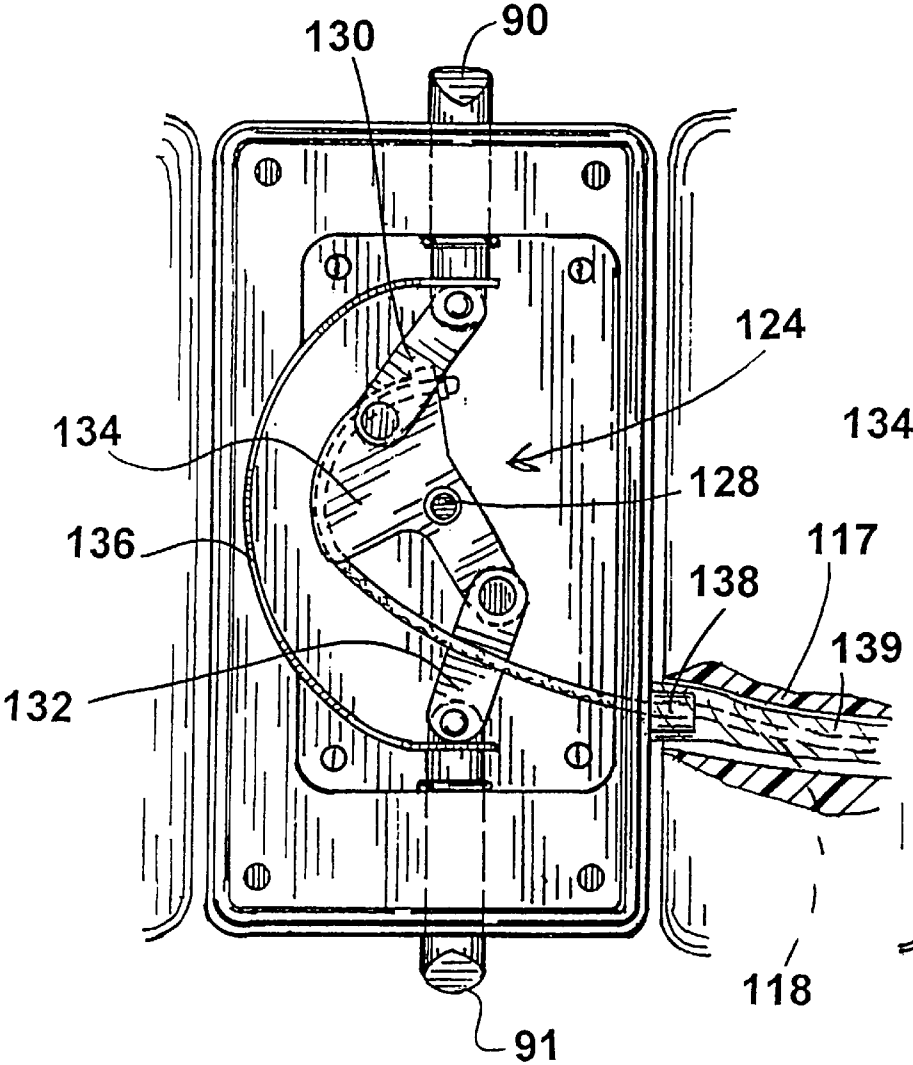
Figure 21:
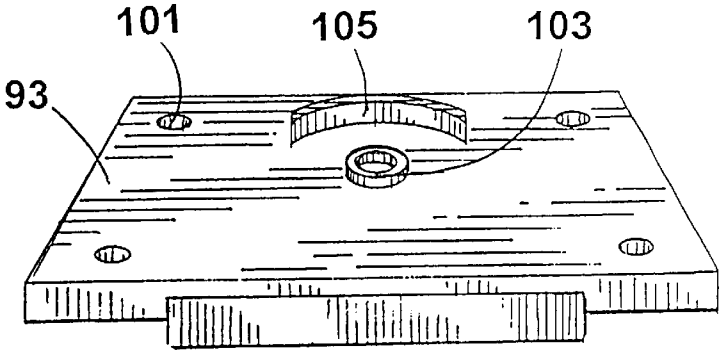
FIG. 21 is a drawing of the pin linkage cover plate with the interior surface oriented for viewing.

Detailed structural features of the linkages may be best understood by referring to FIGS. 14 and 15 which show toe linkage 124 in enlarged views in the pins extended and pins retracted configurations, respectively. Linkage 124 employs a pin link 130 and a pin link 132. Link 130 is rotatably connected to pin 90 and link 132 is rotatably connected to pin 91. Each such link is also connected to a crank 134 which rotates about a pivot 128. A leaf spring 136 is connected at its opposite ends to pins 90 and 91 and provides a force necessary to fully extend the pins whenever retraction wire 118 is relaxed. This relaxed configuration is depicted in FIG. 14. When retraction wire 118 is placed under tension by pulling on pull cord 112 (see FIG. 11 and 13), crank 134 is rotated thereby pulling in links 130 and 132 and retracting pins 90 and 91 until they are substantially flush with the surfaces of compartment 88. Spring 136 is bent further to resist the movement of crank 134 about pivot 128. A tube stub 138 and a soft plastic tube 139 assure that the compartment interior remains dry and clean and that the retraction wire 118 remains unobstructed. As shown in FIG. 21, the interior surface of compartment cover 93 comprises a plurality of attachment holes 101, a fulcrum cap 103 and a wire guide 105. The wire guide prevents retraction wire 118 from slipping off crank 134. Cap 103 provides added support to pivot fulcrum 128.

Figure 16:
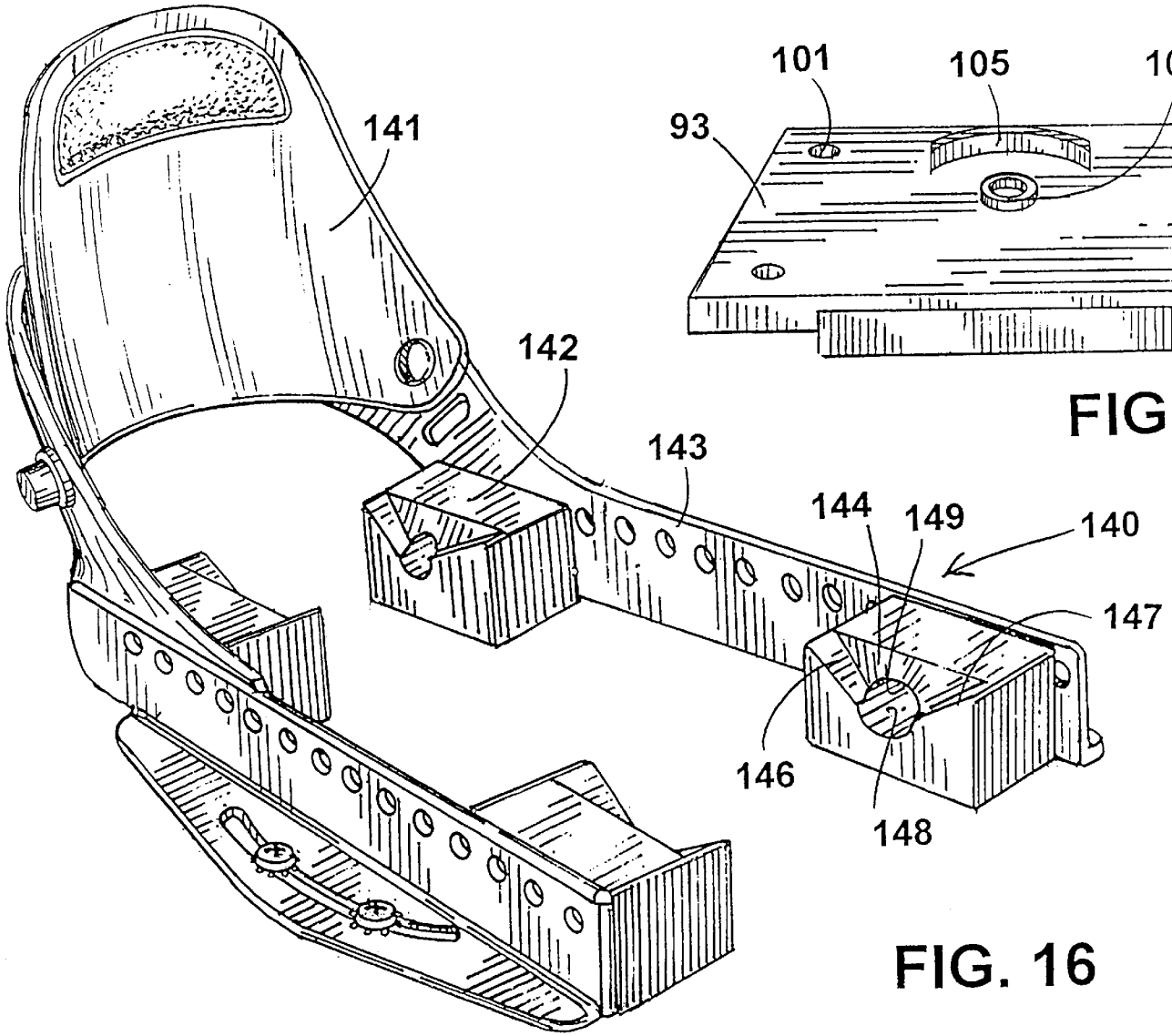
FIGS. 16 through 20 illustrate various alternative pin receptacle configurations in the binding portion of the invention.
Figure 17:
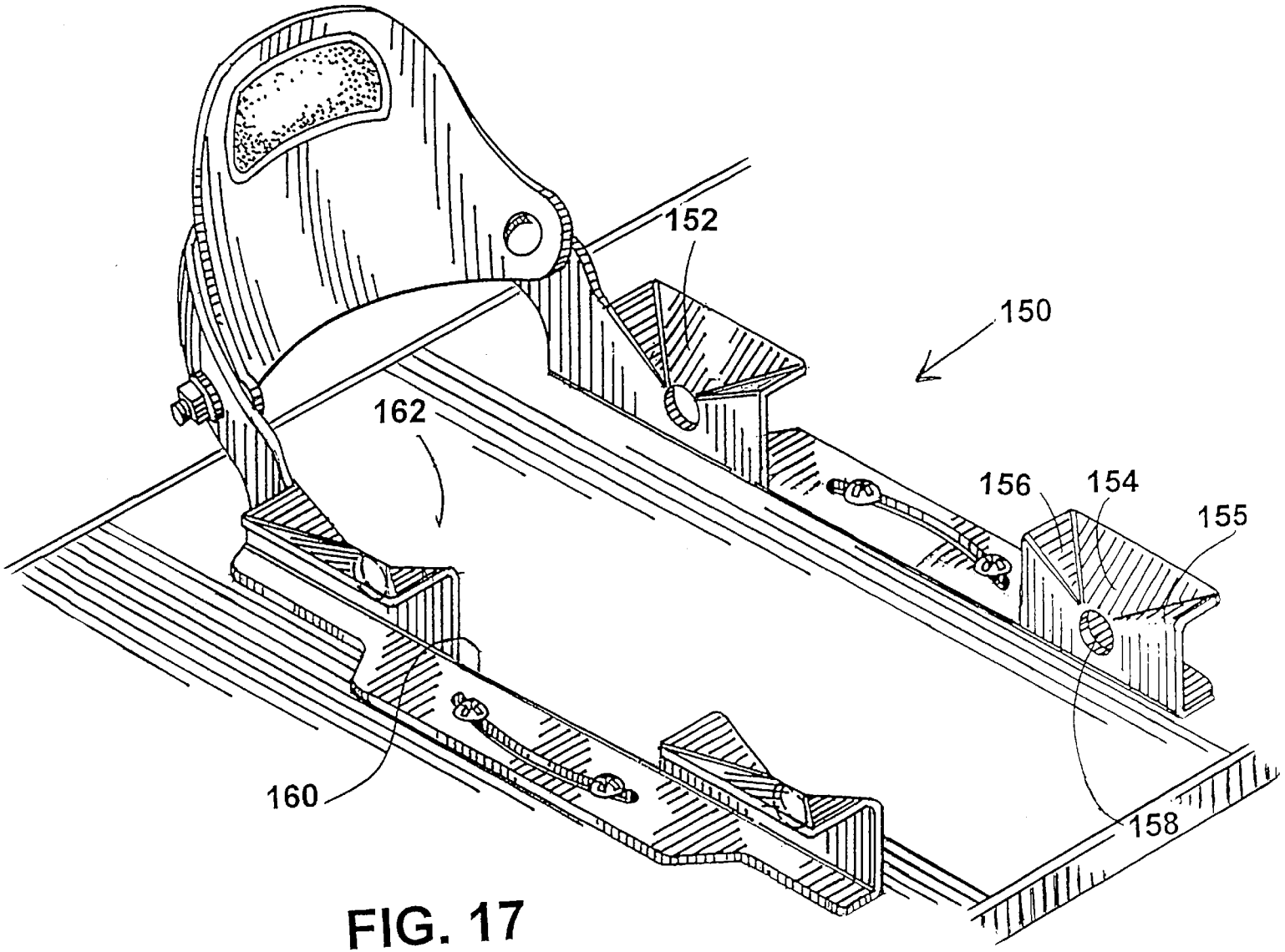

FIGS. 16 through 20 provide views of various binding embodiments which may be used with the boot of the invention. In FIG. 16 a binding 140 has a heel support 141, four pin blocks 142 and a binding frame 143, all integrated as a unitary piece. Each pin block 142 has a side guide surface 144, a back guide surface 146 and a front guide surface 147. The guide surfaces are all inclined toward a pin receiving hole 148 having a canted inlet 149 to more easily receive a boot pin. In FIG. 17 a binding 150 has four pin retainers 152 and a binding frame 160 connecting to a snowboard 162. Each pin retainer 152 has a side guide surface 154, a front guide surface 155 and a back guide surface 156, each inclined toward a pin receiving hole 158. The shapes of retainers 152 and frame 160 reduce snow and ice retention to facilitate unobstructed boot-to-binding step-in interconnection.

Figure 18:
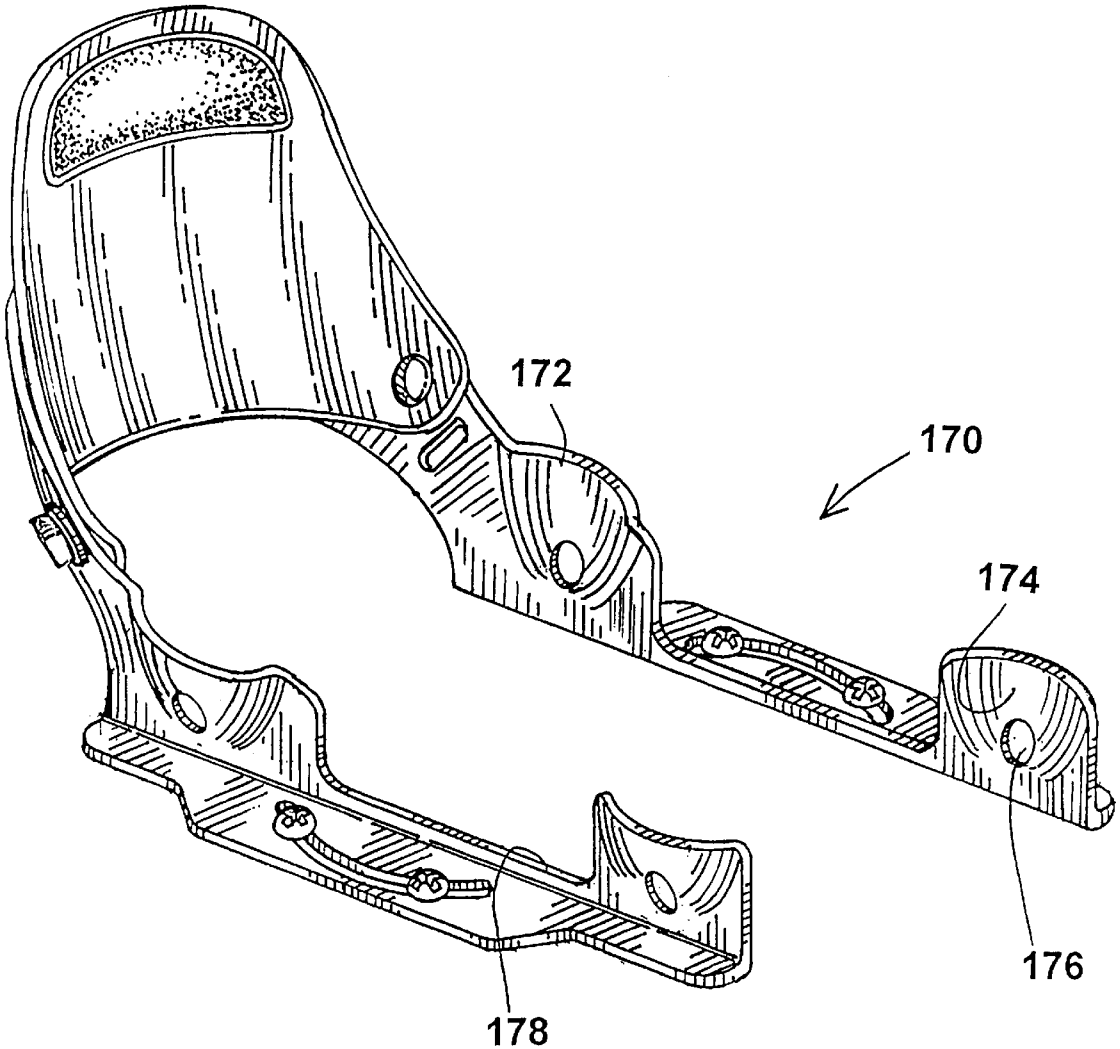
Figure 19:
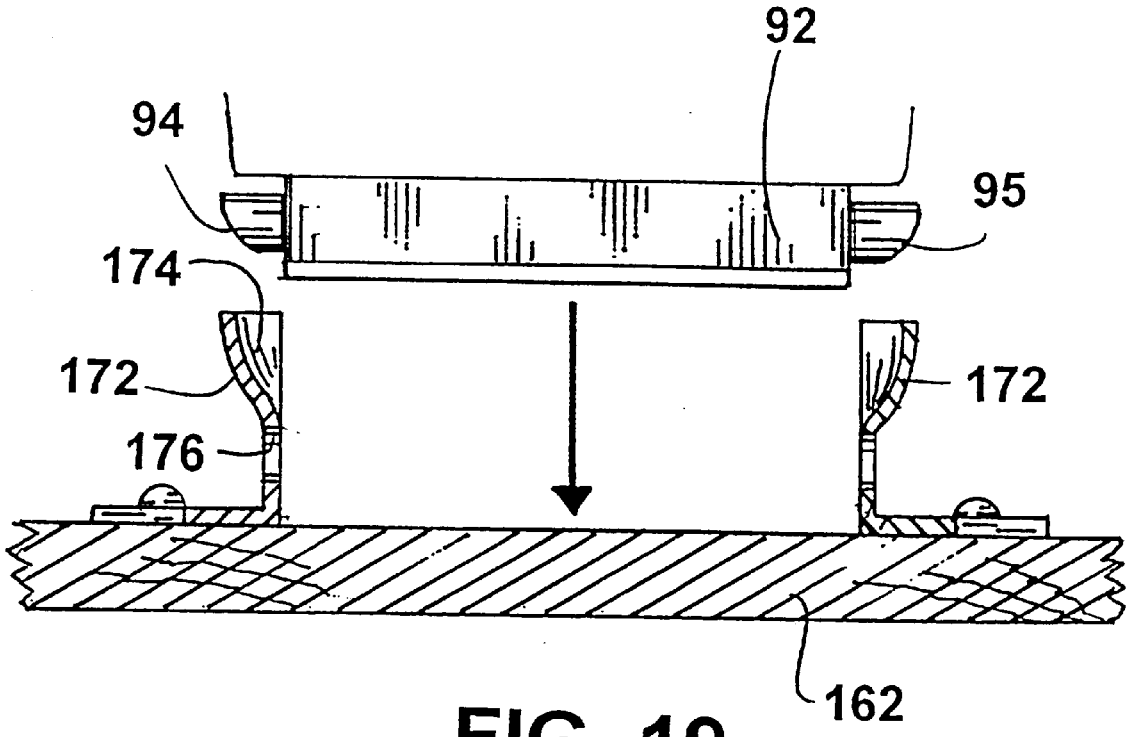
Figure 20:
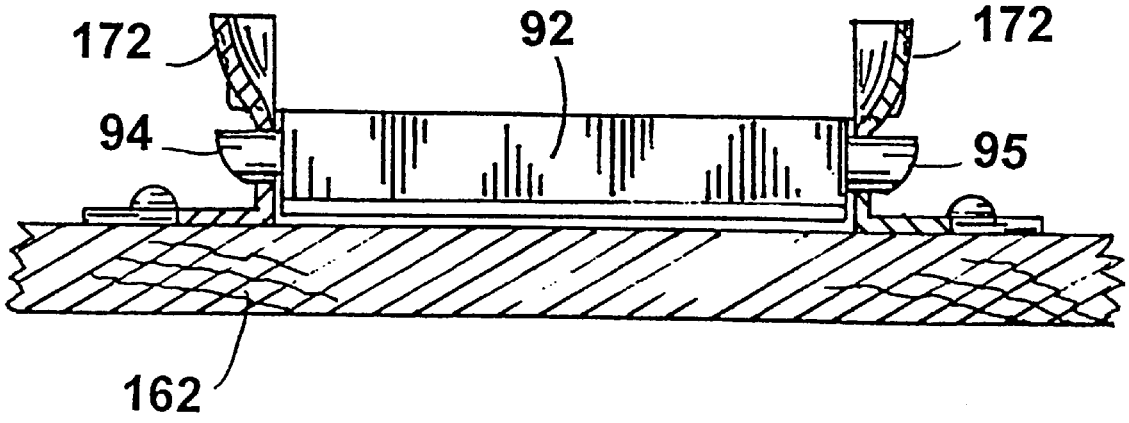

In FIGS. 18 through 20, a binding 170 has four pin retainers 172 and a binding frame 178 as an integrated member. Each pin retainer has a concave surface 174 leading to a pin receiving hole 176. The step-in interconnection of pins 94 and 95 with the respective pin retainer is shown in FIGS. 19 and 20.

Thus it will be seen that the illustrated embodiments satisfy all of the objects of the invention heretofore indicated. Moreover, the present invention clearly provides improved performance, control, stability and ease of use for snowboard boot/binding interface. Interconnection is superior, attachment and release are more convenient and the preferred structure is simple and low cost.

Having thus disclosed the presently contemplated embodiments of the invention for purposes of explaining the structure and operation thereof, it being understood that the disclosed embodiments are illustrative and not limiting,

What i claim is:

1. A boot and binding assembly for snowboards, the assembly providing selective interconnection between the binding attached to the snowboard and at least one boot worn by a snowboard user; the assembly comprising:

a boot having an upper member and a lower member and having at least four projection devices extending from opposing sides of the boot along said lower member, two of said devices being closer to the rear or said boot and two of said devices being closer to the front of said boot; and a binding having a least four receptacles for receiving said boot projection devices; and projection device attachment means for selectively retracting said projection devices to permit separation of said boot and said binding;

said projection device attachment means defining a pair of rotatably displaceable linkage members, each of said linkage members coupled to a respective pair of said projecting devices; and a pull cord coupled to both of said linkage members for rotationally actuating each of said linkage members simultaneously and simultaneously displacing said projection devices; said projection devices being spring loaded to normally extend from said boot.

2. The boot and binding assembly recited in claim 1 wherein each of said receptacles comprises inclined surfaces feeding an aperture for receiving one of said projection devices.

3. The boot and binding assembly recited in claim 1 wherein said pull cord is coupled to each said linkage member by a respective pulley and a respective wire.

4. The boot and binding assembly recited in claim 3 wherein said pull cord is affixed to each said pulley through a common hole.

5. The boot and binding assembly recited in claim 1 further comprising a pair of enclosed compartments, each said compartment containing one of said linkage members.

6. The boot and binding assembly recited in claim 5, said lower member having a sole, each said compartment being substantially flush with said sole.

7. The boot and binding assembly recited in claim 5 wherein each said compartment is enclosed by a cover having an extending guide for preventing decoupling of a corresponding one of said linkage members from said pull cord.

8. The boot and binding assembly recited in claim 1 said boot further comprising at least two belts forming an adjustable yoke for securing said boot to a snowboard user's foot.

9. The boot and binding assembly recited in claim 1 wherein said projection devices are spring loaded by a leaf spring having opposed ends respectively connected to said projection devices.

10. A boot and binding assembly for snowboards, the assembly providing selective interconnection between the binding attached to the snowboard and at least one boot worn by a snowboard user, the assembly comprising:

a boot having an upper member and a lower member and having at least four projection devices extending from opposing sides of the boot along said lower member, two of said devices being closer to the rear of said boot and two of said devices being closer to the front of said boot; and linkage members respectively attached to said projection devices for selectively retracting said devices to permit separation of said boot and said binding;

said projection devices comprising elongated pins and said receptacles comprising apertures sized to received said pins; said elongated pins being spring loaded to nominally extend beyond the lower member of said boot; said receptacles being shaped to funnel said pins into said apertures; said means for retracting comprising a pair of rotatable arms within said lower member, each of said rotatable arms attached to two of said projection devices and a pull cord attached to an end of each of said arms for selectively simultaneously rotating each of said arms for simultaneously retracting said projection devices, said cord being also attached to a handle accessible to a snowboard user.

11. The boot and binding assembly recited in claim 10 wherein each of said receptacles comprises inclined surfaces feeding an aperture for receiving one of said projection devices.

12. The boot and binding assembly recited in claim 10 wherein said pull cord is coupled to each said linkage member by a respective pulley and a respective wire.

13. The boot and binding assembly recited in claim 12 wherein said pull cord is affixed to each said pulley through a common hole.

14. The boot and binding assembly recited in claim 10 further comprising a pair of enclosed compartments, each said compartment containing one of said linkage members.

15. The boot and binding assembly recited in claim 14, said lower member having a sole, each said compartment being substantially flush with said sole.

16. The boot and binding assembly recited in claim 14 wherein each said compartment is enclosed by a cover having an extending guide for preventing decoupling of a corresponding one of said linkage members from said pull cord.

17. The boot and binding assembly recited in claim 10 said boot further comprising at least two belts forming an adjustable yoke for securing said boot to a snowboard user's foot.

18. The boot and binding assembly recited in claim 10 wherein said projection devices are spring loaded by a leaf spring having opposed ends respectively connected to said projection devices.

* * * * *